US008573580B2

(12) United States Patent
Izumichi et al.

(10) Patent No.: US 8,573,580 B2
(45) Date of Patent: Nov. 5, 2013

(54) SHEET POST-PROCESSING APPARATUS AND IMAGE FORMING APPARATUS

(75) Inventors: Sachio Izumichi, Osaka (JP); Masahiko Miyazaki, Osaka (JP); Yasunori Ueno, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 357 days.

(21) Appl. No.: 13/016,796

(22) Filed: Jan. 28, 2011

(65) Prior Publication Data

US 2011/0236108 A1 Sep. 29, 2011

(30) Foreign Application Priority Data

Mar. 25, 2010 (JP) ..... 2010-070605

(51) Int. Cl.
*B41F 13/56* (2006.01)
*G03G 15/00* (2006.01)

(52) U.S. Cl.
USPC ..... 270/20.1; 270/4; 270/32; 270/39.01; 399/407

(58) Field of Classification Search
USPC ..... 270/32, 39.01, 39.04, 39.06, 39.07, 270/39.08, 4, 8, 20.1; 399/407
See application file for complete search history.

(56) References Cited

U.S. PATENT DOCUMENTS 6,746,390 B2 * 6/2004 Tamura et al. ..... 493/445
7,850,155 B2 * 12/2010 Mizubata et al. ..... 270/32
8,267,391 B2 * 9/2012 Mizubata et al. ..... 270/39.01

FOREIGN PATENT DOCUMENTS

JP H06-234462 A 8/1994
JP 2005-225675 A 8/2005
JP 2006-290616 A 10/2006
JP 2009-173430 8/2009

OTHER PUBLICATIONS

Notice of Reasons for Rejection issued to JP Application No. 2010-070605, mailed Apr. 17, 2012.

* cited by examiner

*Primary Examiner* — Ren Yan
(74) *Attorney, Agent, or Firm* — Knobbe Martens Olson & Bear LLP

(57) ABSTRACT

A first folding portion includes: a first folding roller pair consisting of a common roller and a first roller; and a blade member that feeds a sheet to a first nip, thereby forming a first fold on the sheet in the first nip. A second folding portion includes a second folding roller pair consisting of the common roller and a second roller, thereby forming a second fold on the sheet in a second nip. The common roller and the first roller are parallel in a conveying direction in a case where the sheet is guided toward the first folding portion. A feeding portion evacuates the sheet to the evacuation guiding portion for evacuating the sheet that on which the first fold is formed, switches back the sheet, and then feeds the sheet into the second nip.

13 Claims, 11 Drawing Sheets

SHEET POST-PROCESSING APPARATUS AND IMAGE FORMING APPARATUS

This application is based on and claims the benefit of priority from Japanese Patent Application No. 2010-070605, filed on 25 Mar. 2010, the content of which is incorporated herein by reference.

BACKGROUND OF THE INVENTION

1. Field of the Invention

The present invention relates to a sheet post-processing apparatus that performs post-processing such as folding processing on a sheet on which an image is formed in an image forming apparatus main body, and an image forming apparatus including the image forming apparatus main body and the sheet post-processing apparatus.

2. Related Art

Conventionally, a sheet post-processing apparatus, which performs post-processing on a sheet (or a stack of sheets) on which an image is formed in an image forming apparatus main body such as a copy machine, a multi-functional printer and the like, is used. The sheet post-processing apparatus is provided adjacently to the image forming apparatus main body. As the post-processing, punching processing on the sheet, staple processing on the stack of sheets, and double- and triple-fold processing on the sheet (the stack of sheets) can be exemplified.

A conventional sheet post-processing apparatus that can perform the double- and triple-fold processing on the sheet includes, for example: a first folding portion having a first folding roller pair consisting of a common roller and a first roller that forms a first fold on a sheet; a second folding portion having a second folding roller pair consisting of the common roller and a second roller that forms a second fold on the sheet on which the first fold is formed; and a destination switching portion that switches a delivery destination of the sheet on which the first fold is formed between the second folding portion and an ejection portion, the destination switching portion allowing selection of double- or triple-fold processing by switching the delivery destination of the sheet.

SUMMARY OF THE INVENTION

However, in the conventional sheet post-processing device, space optimization in a structure of the first folding portion and the second folding portion is not sufficient. Given this, as a sheet post-processing apparatus allowing the double- and triple-fold processing, a sheet post-processing apparatus that can improve the structure of the first folding portion and the second folding portion thereby realizing further size reduction is awaited. In addition, a sheet post-processing apparatus that can realize simplification of structure and size reduction of a feeding portion, which bends and feeds a sheet on which a first fold is formed by the first folding portion to a second folding portion, is awaited.

The present invention aims at providing, as a sheet post-processing apparatus allowing the double- and triple-fold processing, a sheet post-processing apparatus that can realize further size reduction and simplification of structure.

In addition, the present invention aims at providing an image forming apparatus provided with the sheet post-processing apparatus.

The present invention relates to a sheet post-processing apparatus including: a first folding portion that forms a first fold on a sheet; a second folding portion that forms a second fold on the sheet on which the first fold is formed by the first folding portion; and a destination switching portion that switches a delivery destination of the sheet on which the first fold is formed by the first folding portion between the second folding portion and a first ejection portion, the sheet post-processing apparatus being configured such that a first folding mode or a second folding mode can be selected, the first folding mode forming the first fold but not the second fold on the sheet by operating the first folding portion and switching the delivery destination of the sheet to the first ejection portion with the destination switching portion, and the second folding mode forming the first fold and the second fold on the sheet by switching the delivery destination of the sheet to the second folding portion with the destination switching portion and then operating the second folding portion, in which: the first folding portion includes a first folding roller pair consisting of a common roller, a first roller, and a first nip formed between the common roller and the first roller, and a blade member that bends and feeds the sheet into the first nip, forms the first fold on the sheet in the first nip, and dispatches the sheet on which the first fold is formed toward the first ejection portion; the second folding portion includes a second folding roller pair consisting of the common roller, a second roller, and a second nip formed between the common roller and the second roller, and a feeding portion that bends and feeds the sheet on which the first fold is formed by the first folding portion into the second nip, forms the second fold on the sheet in the second nip, and dispatches the sheet on which the first and second folds are formed toward a second ejection portion; the common roller and the first roller are parallel in a conveying direction in a case where the sheet is guided toward the first folding portion; an axial direction of the common roller and the first roller is substantially parallel to a conveyance surface including the conveying direction; the blade member moves in a direction substantially orthogonal to the conveyance surface; and the feeding portion includes an evacuation guiding portion for evacuating the sheet that brings in and deflects the sheet on which the first fold is formed by the first folding portion, and evacuates the sheet to the evacuation guiding portion, switches back the sheet, and feeds the sheet into the second nip.

The present invention can provide, as a sheet post-processing apparatus allowing the double- and triple-fold processing, a sheet post-processing apparatus that can realize further size reduction and simplification of structure.

In addition, the present invention can provide an image forming apparatus provided with the sheet post-processing apparatus.

DETAILED DESCRIPTION OF THE INVENTION

Figure 1:
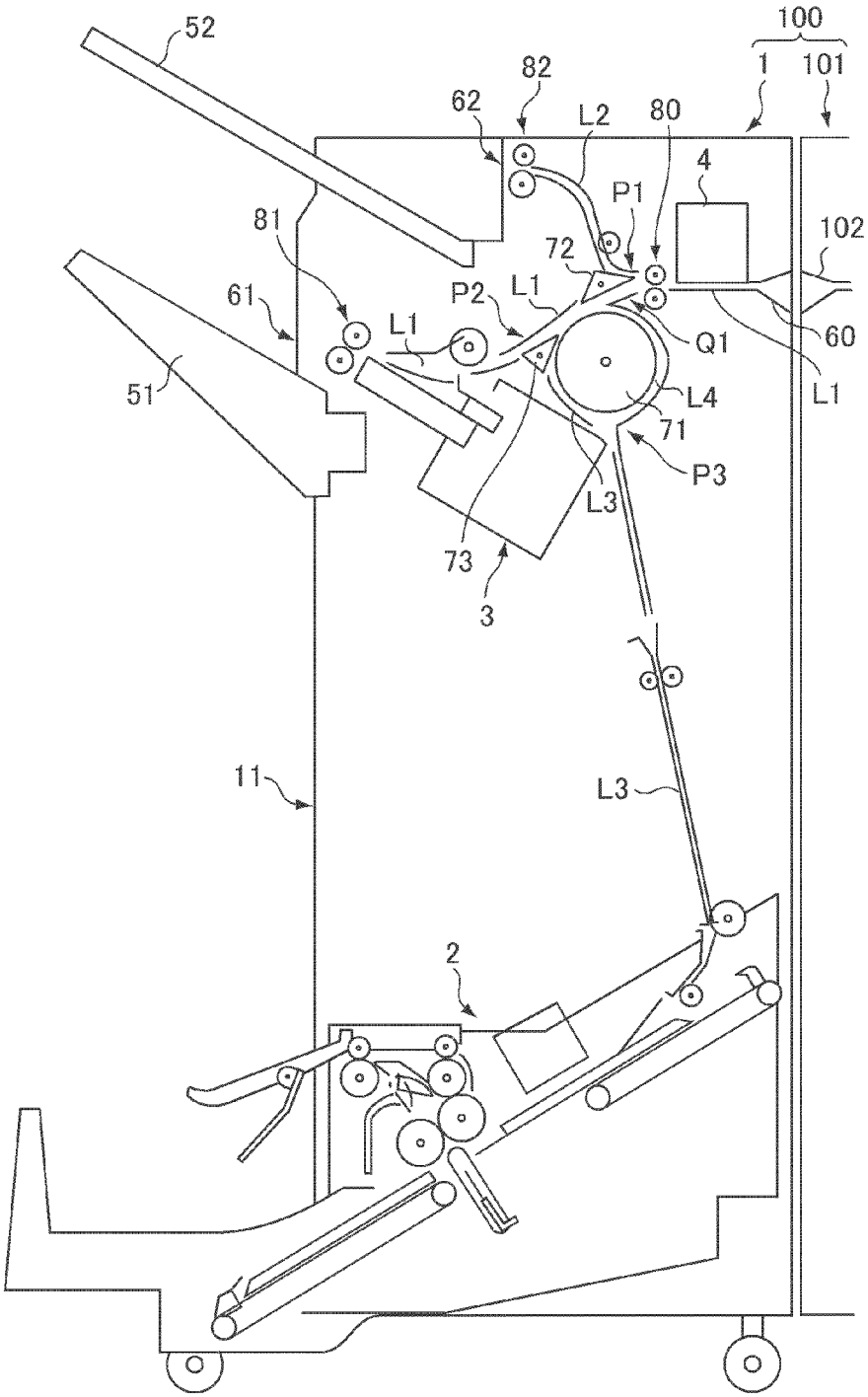
FIG. 1 is a schematic cross-sectional view illustrating an outline of a multi-functional printer main body 101 constituting a multi-functional printer 100 and a sheet post-processing apparatus 1 as an embodiment according to the present invention.

A multi-functional printer 100 as an embodiment of the image forming apparatus according to the present invention is described hereinafter with reference to the drawings. FIG. 1 is a schematic cross-sectional view illustrating an outline of a multi-functional printer main body 101 constituting a multi-functional printer 100 and a sheet post-processing apparatus 1. As shown in FIG. 1, the multi-functional printer 100 of the present embodiment includes: a multi-functional printer main body 101 as an image forming apparatus main body including an image forming unit (not shown) that forms an image on a sheet; and the sheet post-processing apparatus 1.

The multi-functional printer main body 101 includes an image forming unit (not shown) that forms an image on a sheet such as paper, and a main body ejection portion 102 that ejects the sheet, on which an image is formed (printed) by the image forming unit, toward the sheet post-processing apparatus 1 and the like.

As shown in FIG. 1, the sheet post-processing apparatus 1 carries the sheet T, on which an image is formed in the multi-functional printer main body 101, ejected from the multi-functional printer main body 101, into a housing 11 of the sheet post-processing apparatus 1 via a carry-in portion 60 provided in an upper portion of a right lateral face of the sheet post-processing apparatus 1. Thereafter, post-processing such as staple processing and fold processing is performed on the sheet T being carried in.

The sheet post-processing apparatus 1 includes a sheet fold processing portion 2, a staple processing portion 3, a punching portion 4, a main ejection tray 51, and a sub ejection tray 52. In addition, the sheet post-processing device 1 includes the carry-in portion 60, a first path L1, a second path L2, a third path L3, a first branch portion P1, a second branch portion P2, a third branch portion P3, a first junction Q1, the main ejection portion 61, the sub ejection portion 62, an evacuation drum 71, various switching members, and various rollers and roller pairs.

First, a configuration regarding conveyance of the sheet T is described.

The carry-in portion 60 is a portion through which the sheet T, which is ejected from the main body ejection portion 102 of the multi-functional printer main body 101, is carried in.

The first path L1 conveys the sheet T carried in through the carry-in portion 60 to the main ejection portion 61. The sheet T ejected from the main ejection portion 61 is ejected to the main ejection tray 51.

The second path L2 branches off from the first path L1 at the first branch portion P1. The second path L2 conveys the sheet T being conveyed in the first branch portion P1 to the sub ejection portion 62. The sheet T ejected from the sub ejection portion 62 is ejected to the sub ejection tray 52.

The third path L3 branches off from the first path L1 at the second branch portion P2 and extends up to the sheet folding processing portion 2. The second branch portion P2 is positioned on a downstream side of the first branch portion P1 on the first path L1.

The fourth path L4 branches off from the third path L3 at the third branch portion P3, curves along a periphery of the evacuation drum 71, and joins the first path L1 at the first junction Q1. The first junction Q1 is positioned between the first branch portion P1 and the second branch portion P2 on the first path L1.

A first intermediate roller pair 80 is disposed in front of the first branch portion P1 on the first path L1. The first intermediate roller pair 80 dispatches the sheet T, being conveyed in front of the first branch portion P1 on the first path L1, toward a downstream side.

A first switching arm 72 is provided in the first branch portion P1. The first switching arm 72 switches a delivery destination of the sheet T, being conveyed on the first path L1, between the first path L1 and the second path L2. A second switching arm 73 is provided in the second branch portion P2.

The second switching arm 73 switches a delivery destination of the sheet T, being conveyed on the first path L1, between the first path L1 and the third path L3.

The punching portion 4 is disposed to face a region between the carry-in portion 60 and the first branch portion P1 on the first path L1. The punching portion 4 performs punching processing on the sheet T at a predetermined timing.

A main ejection roller pair 81 is disposed on an end portion of the first path L1 and in the vicinity of the main ejection portion 61. The main ejection roller pair 81 dispatches the sheet T, being conveyed in the end portion of the first path L1, to the main ejection tray 51. In addition, when dispatching the sheet T to the staple processing portion 3, the main ejection roller pair 81 is spaced away from each other and unlocks the nip. Thereafter, the sheet is dispatched to the staple processing portion 3 by a sheet dispatching mechanism (not shown).

The main ejection tray 51 receives the sheet T ejected by the main ejection roller pair 81 from the main ejection portion 61.

The main ejection tray 51 mainly receives a stack of the sheet T ejected from the main ejection portion 61 after the staple processing in the staple processing portion 3. The main ejection tray 51 lowers sequentially from the uppermost position, according to increase in the number of stacks of the sheets T ejected. Thereafter, the main ejection tray 51 moves up when the stacks of the sheets T are removed therefrom and returns to a normal position.

Alternatively, the sheet post-processing apparatus 1 can be configured such that the main ejection tray 51 receives the sheet T being ejected with no post-processing or only with punching.

A sub ejection roller pair 82 is disposed on an end portion of the second path L2 and in the vicinity of the sub ejection portion 62. The sub ejection roller pair 82 dispatches the sheet T, being conveyed in the end portion of the second path L2, to the sub ejection tray 52. The sub ejection tray 52 receives the sheet T ejected by the sub ejection roller pair 82 from the sub ejection portion 62. The sub ejection tray 52 mainly receives the sheet T being ejected with no post-processing performed or only with punching performed in the sheet post-processing apparatus 1.

The sheet folding processing portion 2 is disposed in a lower portion of the housing 11. The sheet folding processing portion 2 is described later in detail.

The staple processing portion 3 performs stacking processing that makes a stack of the sheets T by stacking a plurality of the sheets T. The staple processing portion 3 can perform various staple processing. As the staple processing, edge fastening, in which an edge of the stack of the sheets T is stapled, and center fastening, in which a center in a longitudinal direction of the stack of the sheets T is stapled twice along a width direction, can be exemplified. The edge fastening includes edge center fastening, in which vicinities of a center of an edge of the stack of the sheets T is stapled twice along the longitudinal direction, and edge oblique fastening, in which one end of the edge of the stack of the sheets T is stapled once at an angle of 45 with respect to the edge. The stack of the sheets T after the stacking processing or the edge fastening is ejected by the main ejection roller pair 81 from the main ejection portion 61.

The evacuation drum 71 conveys the sheet T, which branches from the first path L1 and is conveyed on the third path L3, to the fourth path L4 and circulates the sheet T via the first path L1. The sheet T can thus be temporarily evacuated. In a case of consecutively performing the staple processing on a plurality of stacks of the sheets T, while a first stack of the sheets T is being stapled by the staple processing portion 3, the evacuation drum 71 wraps and holds a first sheet of a second stack of the sheets T around a surface of the evacuation drum 71. With such a function of the evacuation drum 71, it is no longer required to suspend ejection of the sheet T from the multi-functional printer main body 101 while the staple processing is in progress, thereby improving productivity.

Figure 2:
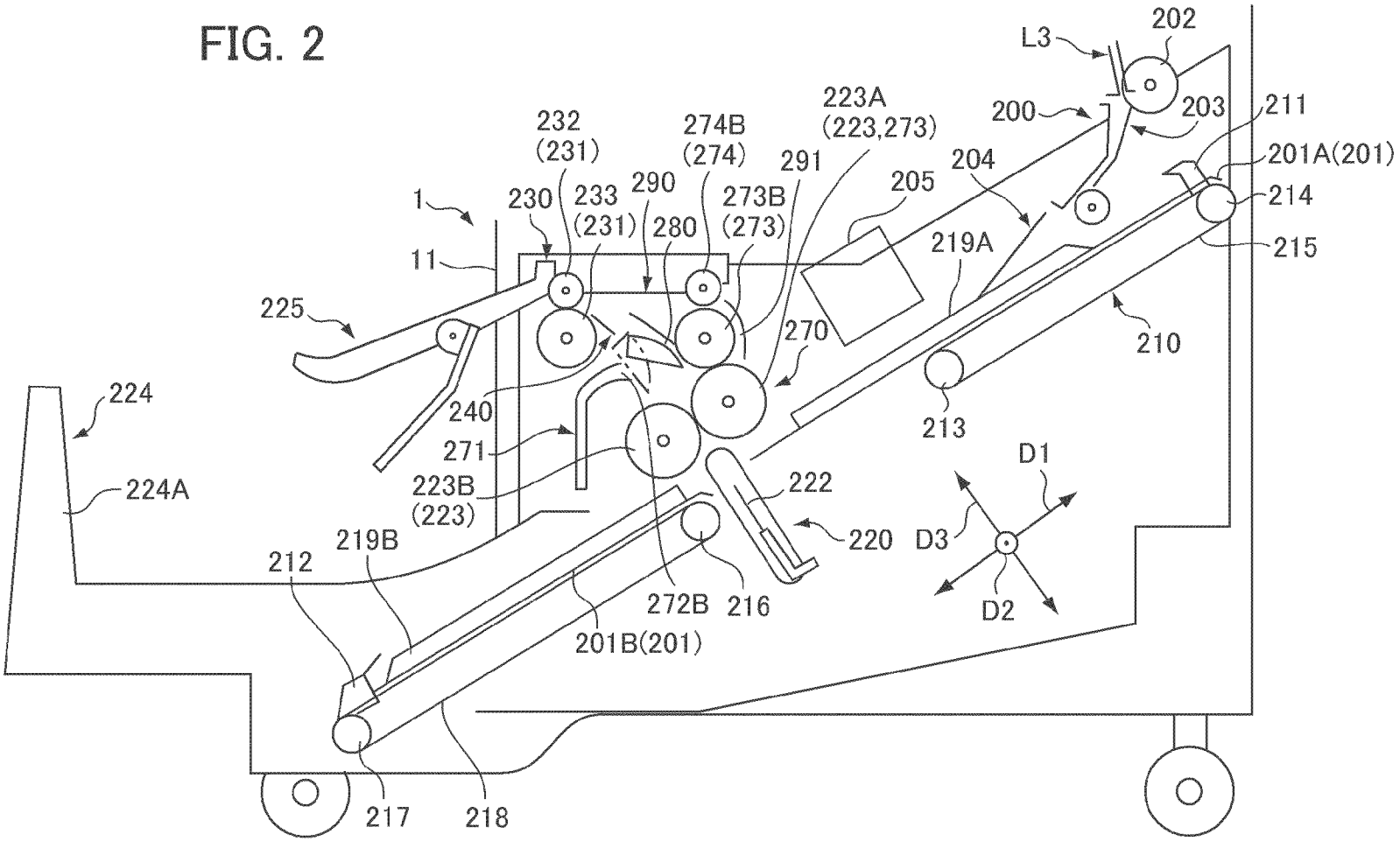
FIG. 2 is a schematic cross-sectional view illustrating a structure of a sheet folding processing portion 2 in the sheet post-processing apparatus 1 shown in FIG. 1.
Figure 3:
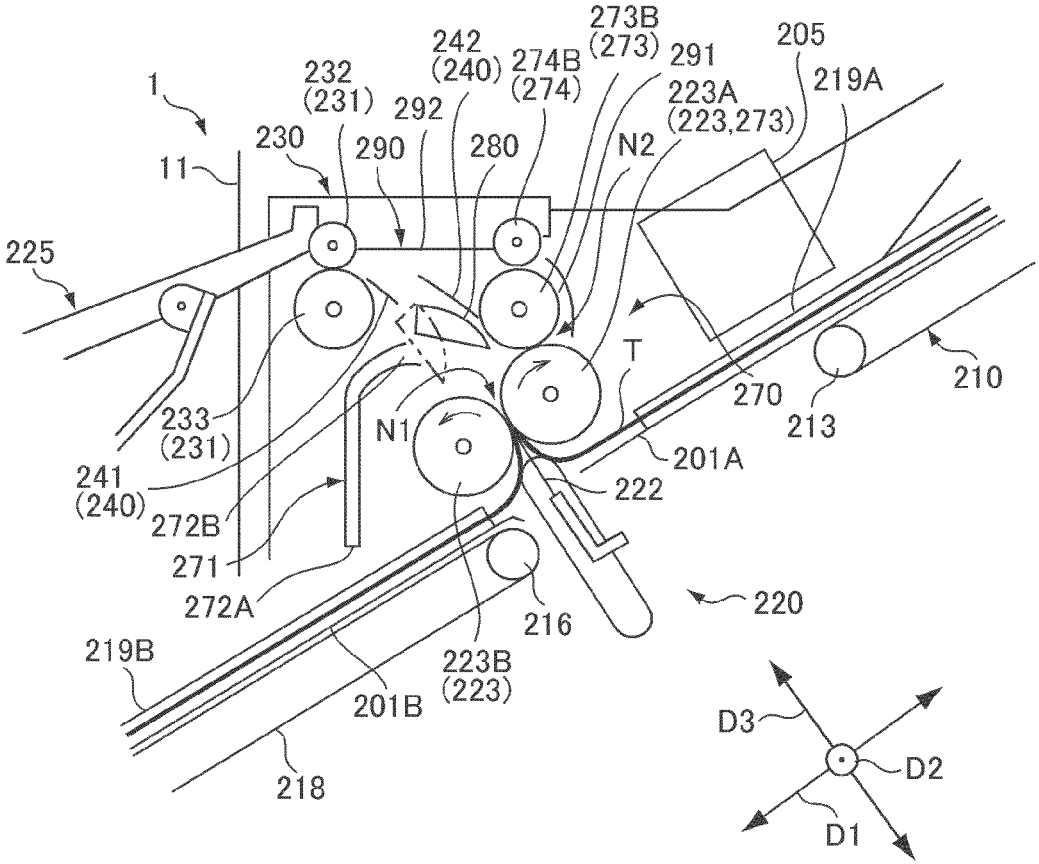
FIG. 3 is a schematic cross-sectional view illustrating a process of forming a first fold on a sheet T in the sheet folding processing portion 2 shown in FIG. 2.
Figure 4:
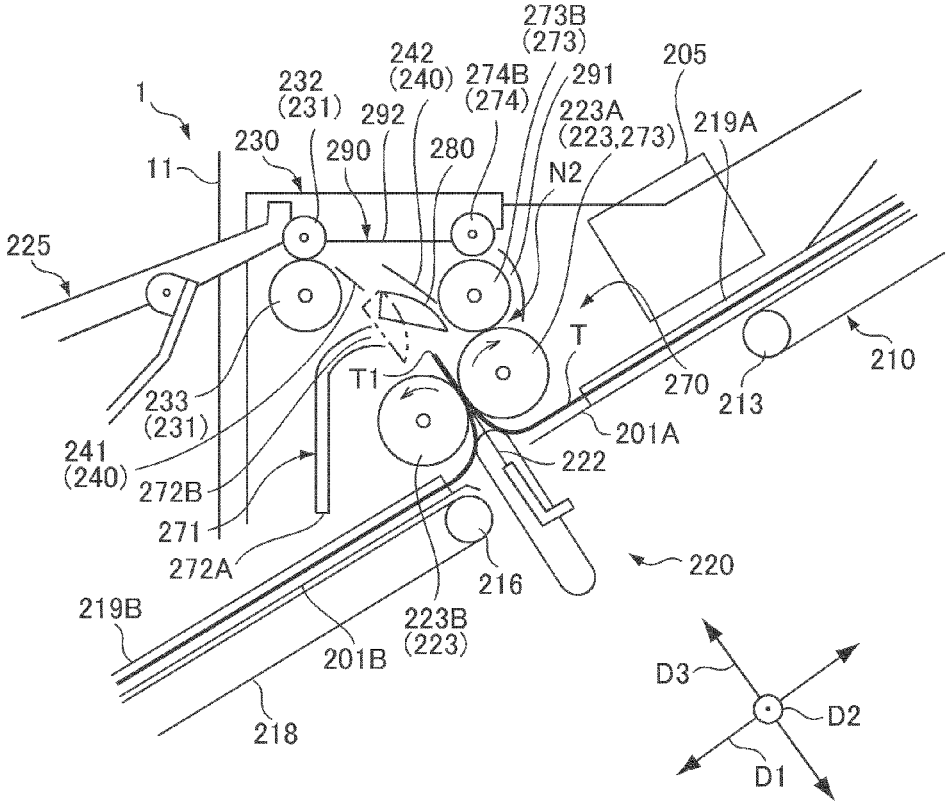
FIG. 4 is a schematic cross-sectional view illustrating a state after the process shown in FIG. 3, in which a first fold T1 is formed on the sheet T.

Next, an overview of a structure of the sheet folding processing portion 2 in the sheet post-processing apparatus 1 of the present embodiment is described with reference to FIGS. 2 to 4. FIG. 2 is a schematic cross-sectional view illustrating a structure of the sheet folding processing portion 2 in the sheet post-processing apparatus 1 shown in FIG. 1. FIG. 3 is a schematic cross-sectional view illustrating a process of forming a first fold on a sheet T in the sheet folding processing portion 2 shown in FIG. 2. FIG. 4 is a schematic cross-sectional view illustrating a state after the process shown in FIG. 3, in which a first fold T1 is formed on the sheet T.

In the following description, "sheet T" includes a stack of the sheets T for the sake of convenience.

As shown in FIG. 2, the sheet folding processing portion 2 according to the present embodiment is disposed in the lowermost portion of the housing 11 of the sheet post-processing apparatus 1. The sheet folding processing portion 2 is provided on a downstream side of the third path L3. Into the sheet folding processing portion 2, a sheet T and a stack of the sheets T being stapled, for example, are introduced. The sheet folding processing portion 2 performs folding processing on the sheet T. Upon selection of the folding processing by a user, the sheet folding processing portion 2 performs folding processing such as double-fold, triple-fold and the like on the sheet T and ejects the sheet T being folded to a lower ejection tray 224 provided in a lower portion of a side face of the housing 11 of the sheet post-processing apparatus 1.

The sheet folding processing portion 2 includes a sheet carry-in path 200, a sheet placing member 201 (an upstream sheet placing member 201A and a downstream sheet placing member 201B), an alignment portion 210, a pushing member 211, a receiving member 212, a first folding portion 220, a second folding portion 270, a destination switching member 280 as the destination switching portion, and an ejection portion (a first ejection portion and a second ejection portion) 230.

The sheet carry-in path 200 is a path for carrying the sheet T, being conveyed on the third path L3, into the sheet folding processing portion 2. The sheet carry-in path 200 is provided in an upper right portion of the sheet folding processing portion 2, in FIG. 2. The sheet carry-in path 200 includes a carry-in roller pair 202, carry-in guides 203 and 204. The carry-in roller pair 202 and the carry-in guides 203 and 204 carry the sheet T, being conveyed on the third path L3, into the sheet folding processing portion 2. More specifically, the sheet carry-in path 200 carries the sheet T toward the upstream sheet placing member 201A and the downstream sheet placing member 201B (described later).

The carry-in roller pair 202 can be composed of driving rollers. Alternatively, by providing a conveyance roller pair (not shown) in the vicinity of an end portion of the third path L3, the carry-in roller pair 202 can be composed of driven rollers. The carry-in guides 203 and 204 guide the sheet T such that the sheet T is accurately conveyed to the upstream sheet placing member 201A and the downstream sheet placing member 201B.

The upstream sheet placing member 201A and the downstream sheet placing member 201B are members on which the sheet T is placed for performing the folding processing on the sheet T being carried in. As shown in FIG. 2, the upstream sheet placing member 201A and the downstream sheet placing member 201B are provided inside the sheet folding processing portion 2 from an upper right side to a lower left side, and extend so as to divide obliquely the inside of the sheet folding processing portion 2. The sheet T carried to the upstream sheet placing member 201A and the downstream sheet placing member 201B is placed on the upstream sheet placing member 201A and the downstream sheet placing member 201B.

The sheet T placed on the upstream sheet placing member 201A and the downstream sheet placing member 201B is fed into a first nip N1 in the first folding roller pair 223 by a blade member 222 (described later in detail). The upstream sheet placing member 201A and the downstream sheet placing member 201B are arranged to be spaced apart from each other across the blade member 222. In other words, the upstream sheet placing member 201A is arranged on an upstream side of the blade member 222 in a sheet conveying direction D1. On the other hand, the downstream sheet placing member 201B is spaced apart from the upstream sheet placing member 201A across the blade member 222 and arranged on a downstream side in the sheet conveying direction D1.

The upstream sheet placing member 201A and the downstream sheet placing member 201B are composed of plate-like members and arranged in line in the sheet conveying direction D1. In addition, the upstream sheet placing member 201A and the downstream sheet placing member 201B extend also in a width direction D2 of the sheet T.

The alignment portion 210 is provided to align the sheet T on the upstream sheet placing member 201A and the downstream sheet placing member 201B, so as to accurately perform the folding processing on the sheet T being carried in. The alignment portion 210 aligns the sheet T in a direction parallel to the sheet conveying direction D1 (left downward direction in FIG. 2) and a direction D2 orthogonal to the sheet conveying direction D1.

As shown in FIG. 2, the pushing member 211 and the receiving member 212 are provided to align a front end and a rear end of the sheet T in the sheet conveying direction D1. The pushing member 211 is arranged on an upstream side in the sheet conveying direction D1. The receiving member 212 is arranged on a downstream side in the sheet conveying direction D1.

The pushing member 211 is formed to have a cross-section that is substantially L-shaped. In addition, a driving pulley 213 and a driven pulley 214 are disposed below the upstream sheet placing member 201A. An endless belt 215 is stretched around the driving pulley 213 and the driven pulley 214. The pushing member 211 is attached to the endless belt 215. In addition, the pushing member 211 projects from above the upstream sheet placing member 201A at a substantially central position in the width direction D2 of the upstream sheet placing member 201A.

The driving pulley 213 is disposed at a position corresponding to the substantially central position of the upstream sheet placing member 201A in the sheet conveying direction D1. The driven pulley 214 is disposed in the vicinity of an upstream end of the upstream sheet placing member 201A. To the driving pulley 213, rotational driving force from a motor (not shown) is transferred by a driving mechanism (not shown). The driving pulley 213 and the driven pulley 214 can rotate back and forth. When the driving pulley 213 rotates, the driven pulley 214 is driven to rotate via the endless belt 215. This makes the pushing member 211 project from above the upstream sheet placing member 201A and move in a direction parallel to the sheet conveying direction D1.

The receiving member 212 is formed to have a cross-section that is substantially L-shaped. In addition, a driving pulley 216 and a driven pulley 217 are disposed below the downstream sheet placing member 201B. An endless belt 218 is stretched around the driving pulley 216 and the driven pulley 217. The receiving member 212 is attached to the endless belt 218. In addition, the receiving member 212 projects from above the downstream sheet placing member 201B at a substantially central position in the width direction D2 of the downstream sheet placing member 201B.

The driving pulley 216 is disposed in the vicinity of an upstream end of the downstream sheet placing member 201B. The driven pulley 217 is disposed in the vicinity of a downstream end of the downstream sheet placing member 201B. To the driving pulley 216, rotational driving force from a motor (not shown) is transferred by a driving mechanism (not shown). The driving pulley 216 and the driven pulley 217 can rotate back and forth. When the driving pulley 216 rotates, the driven pulley 217 is driven to rotate via the endless belt 218. This makes the receiving member 212 project from above the downstream sheet placing member 201B and move a whole length of the downstream sheet placing member 201B, in a direction parallel to the sheet conveying direction D1.

By moving the pushing member 211 and the receiving member 212 according to a size of the sheet T (a length thereof in the conveying direction D1), the sheet T carried into the upstream sheet placing member 201A and the downstream sheet placing member 201B is aligned in a direction parallel to the sheet conveying direction D1, in other words a longitudinal direction of the sheet T.

Widthwise alignment members 219A and 219B are members for aligning the sheet T in the direction D2 orthogonal to the sheet conveying direction D1, in other words in the width direction D2 of the sheet T. The widthwise alignment members 219A and 219B are provided in pairs in a direction parallel to the sheet conveying direction D1. The pairs of widthwise alignment members 219A and 219B are arranged on the upstream sheet placing member 201A and the downstream sheet placing member 201B, across the blade member 222 in the sheet conveying direction D1, with intervals therebetween in the width direction D2. The pairs of widthwise alignment members 219A and 219B align the sheet T widthwise and perform skew compensation. The pair of widthwise alignment members 219A provided on the upstream sheet placing member 201A has a rack and pinion mechanism (not shown). The rack and pinion mechanism is driven in connection with a motor (not shown) that can rotate back and forth.

By moving the widthwise alignment members 219A with the rack and pinion mechanism and the motor according to a size (a length in the width direction D2) of the sheet T being carried onto the upstream sheet placing member 201A and the downstream sheet placing member 201B, widthwise alignment and skew compensation of the sheet T is performed. It should be noted that, although another rack and pinion mechanism and another motor can be provided in the widthwise alignment members 219B, which is arranged more on the downstream side than the blade member 222 in the sheet conveying direction D1, alignment can be generally performed by providing the rack and pinion mechanism and the motor in only one of the widthwise alignment members.

A second staple processing portion 205 is provided above the upstream sheet placing member 201A and on an upstream side of the first folding portion 220. The second staple processing portion 205 performs staple processing to a stack of the sheets T that is subjected to the folding processing in the first folding portion 220 after the staple processing.

Next, the first folding portion 220 is described hereinafter. As shown in FIGS. 2 to 4, the first folding portion 220 forms the first fold T1 on the sheet T in the first nip N1 (described later). The first folding portion 220 dispatches the sheet T on which the first fold T1 is formed toward the ejection portion 230. The first folding portion 220 includes a crank mechanism (not shown), the blade member 222, the first folding roller pair 223 and a first ejection path 240.

The crank mechanism (not shown) is disposed in a central lower portion inside the sheet folding processing portion 2. The crank mechanism is rotationally driven by a motor (not shown) via a power transmission mechanism (not shown). The blade member 222 is attached to the crank mechanism.

The blade member 222 contacts the sheet T so as to push out the sheet T, and bends and feeds the sheet T into the first nip N1 (described later). The blade member 222 moves in a direction D3, which is substantially orthogonal to a conveyance surface (D1-D2) including the conveying direction D1 and the width direction D2 of the sheet.

The first folding roller pair 223 is composed of a common roller 223A and a first roller 223B. The first nip N1 is formed between the common roller 223A and the first roller 223B.

The first folding roller pair 223 is disposed above the crank mechanism and the blade member 222. The common roller 223A and the first roller 223B constituting the first folding roller pair 223 are rotationally driven by a power source such as a motor (not shown) via a power transmission mechanism (not shown).

The common roller 223A and the first roller 223B are parallel in the conveying direction D1 in a case where the sheet T is guided toward the first folding portion 220. An axial direction of the common roller 223A and the first roller 223B is substantially parallel to the direction D2 orthogonal to the conveying direction D1, in other words to the conveyance surface (D1-D2) including the conveying direction D1. The common roller 223A is disposed on an upstream side of the first roller 223B in the sheet conveying direction D1.

The first ejection path 240 is a path for conveying the sheet T from the first folding portion 220 to the ejection portion 230.

The ejection portion 230 ejects the sheet T conveyed on the first ejection path 240 and the sheet T conveyed on the second ejection path 290 from the inside of the sheet folding processing portion 2.

As described later, the second ejection path 290 is a path for conveying the sheet T from the second folding portion 270 to the ejection portion 230.

Next, the second folding portion 270 is described hereinafter. As shown in FIGS. 2 to 4, the second folding portion 270 forms the second fold T2 on the sheet T on which the first fold T1 is formed by the first folding portion 220. The second folding portion 270 dispatches the sheet T on which the second fold T2 is formed toward the ejection portion 230. The second folding portion 270 includes an evacuation guiding portion 271, a second folding roller pair 273, a first auxiliary roller pair 274 and the second ejection path 290.

The evacuation guiding portion 271 is a guiding portion for evacuation of the sheet T that bends and brings in the sheet T on which the first fold T1 is formed by the first folding portion 220. The evacuation guiding portion 271 is disposed on an opposite side to the second folding roller pair 273 across the destination switching member 280 (described later). The evacuation guiding portion 271 is curved at least once along a shape of a peripheral surface of the first roller 223B. The evacuation guiding portion 271 of the present embodiment is curved once.

The evacuation guiding portion 271 includes a sheet introduction opening 272B through which the sheet T is brought in and a dead-end portion 272A.

The sheet introduction opening 272B is a portion through which the sheet T is brought into the evacuation guiding portion 271. The sheet introduction opening 272B is positioned below the destination switching member 280 (described later) and above a nip plane N21 of the second nip N2 of the second folding roller pair 273.

The nip plane N21 is a plane in a tangential direction of the second nip N2. In other words, the nip plane N21 in the second nip N2 is a surface that is orthogonal to a plane passing through central axes of the common roller 223A and the second roller 273B and that passes through the second nip N2.

The dead-end portion 272A is a portion against which the first fold T1 on the sheet T evacuated into the evacuation guiding portion 271 is struck. The dead-end portion 272A is disposed below the upstream end of the downstream sheet placing member 201B.

The second folding roller pair 273 is composed of the common roller 223A and a second roller 273B. The common roller 223A is one roller of the first folding roller pair 223. The second folding roller 273B is positioned above the common roller 223A. The second nip N2 is formed between the common roller 223A and the second roller 273B.

A peripheral surface of the second roller 273B is formed of a material of a low friction coefficient. The friction coefficient thereof is set to such a value that the sheet T can easily slip thereon. As the material of a low friction coefficient, aluminum, POM (polyacetal) and the like can be exemplified. It should be noted that the friction coefficient is affected also by surface roughness.

The second folding roller pair 273 forms the second fold T2 on the sheet T in the second nip N2, and dispatches the sheet T, on which the first fold T1 and the second fold T2 are formed, toward the ejection portion 230.

The first auxiliary roller pair 274 is composed of the second roller 273B and a third roller 274B. The second roller pair 273B is one roller of the second folding roller pair 273. The third roller 274B is positioned above the second folding roller 273B.

The second folding roller 273B can dispatch the sheet T having passed through the second nip N2 of the second folding roller pair 273 toward the ejection portion 230 via the second ejection path 290. As a result, the second folding portion 270 can wrap around the common roller 223A and dispatch toward the ejection portion 230 (the second ejection path 290) the sheet T on which the second fold T2 is formed.

The common roller 223A and the second roller 273B constituting the second folding roller pair 273 are rotationally driven by a power source such as a motor (not shown) via a power transmission mechanism (not shown). The third roller 274B constituting the first auxiliary roller pair 274 is composed of a driven roller.

Next, the destination switching member 280 is described hereinafter. As shown in FIGS. 2 to 4, the destination switching member 280 switches the destination of the sheet T, on which the first fold T1 is formed by the first folding portion 220, between the evacuation guiding portion 271 of the second folding portion 270 and the ejection portion 230 (the first ejection path 240).

The sheet T conveyed on the first ejection path 240 on which only the first fold T1 is formed and the sheet T conveyed on the second ejection path 290 on which the first fold T1 and the second fold T2 are formed are both ejected from the sheet post-processing apparatus 1 through the ejection portion 230.

The second folding portion 270 is provided with a feeding portion that evacuates the sheet T on which the first fold T1 is formed by the first folding portion 220 to the evacuation guiding portion 271, switches back the sheet T, and then bends and feeds the sheet T into the second nip N2. The feeding portion is realized by relationship and cooperation of: a shape of the evacuation guiding portion 271; switching of the destination switching member 280; rotation of the first folding roller pair 223; and the like.

A space surrounded by the common roller 223A, the first roller 223B, the second roller 273B, the evacuation guiding portion 271, and the destination switching member 280 is used as a space to bend the sheet to switch back from the evacuation guiding portion 271 (described later).

With the abovementioned configuration, the sheet post-processing apparatus 1 is configured such that the first folding mode or the second folding mode can be selected.

The first folding mode is a mode for forming the first fold T1 but not the second fold T2 on the sheet T by operating the first folding portion 220 and switching the delivery destination of the sheet T to the ejection portion 230 with the destination switching portion 280. The second folding mode is a mode for forming the first fold T1 and the second fold T2 on the sheet T by operating the first folding portion 220, switching the delivery destination of the sheet T to the second folding portion 270 with the destination switching portion 280, and then operating the second folding portion 270.

The ejection portion 230 is described hereinafter. As shown in FIG. 2, the ejection portion 230 is a portion through which the sheet T after folding processing is ejected from the sheet folding processing portion 2. In the ejection portion 230, a lower ejection roller pair 231 is disposed. The lower ejection roller pair 231 is disposed in an upper portion of a base end portion of the lower ejection tray 224. The lower ejection roller pair 231 is composed of a first lower ejection roller 232 and a second lower ejection roller 233. The first lower ejection roller 232 and the second lower ejection roller 233 are rotatably supported to be vertically arranged, with the first lower ejection roller 232 being at the top. The first lower ejection roller 232 is composed of a driven roller and vertically movable. The second lower ejection roller 233 is composed of a driving roller.

The first lower ejection roller 232 moves in a vertical direction according to a thickness and stiffness of the sheet T that is introduced into the lower ejection roller pair 231 after folding processing. Such a configuration can deal with thickness and stiffness of the sheet T that may differ according to folding processing, thereby suppressing paper jam and crease of the sheet T.

Next, the first ejection path 240 is described hereinafter. As shown in FIGS. 2 to 4, the first ejection path 240 is a path for conveying the sheet T, on which only the first fold T1 is formed, from the first folding roller pair 223 to the lower ejection roller pair 231. The first ejection path 240 is composed of a lower guide 241 and an upper guide 242. The lower guide 241 is formed such that the sheet T having passed through the destination switching member 280 is conveyed to the lower ejection roller pair 231. The upper guide 242 is disposed above the lower guide 241 at an interval. The upper guide 242 also functions as a member for separating the first ejection path 240 from the second ejection path 290 (described later).

Next, the second ejection path 290 is described hereinafter. As shown in FIGS. 2 to 4, the second ejection path 290 is a path for conveying the sheet T, on which the first fold T1 and the second fold T2 are formed, from the second folding roller pair 273 to the lower ejection roller pair 231. The second ejection path 290 includes an upstream second ejection path 291 and a downstream second ejection path 292. The upstream second ejection path 291 is a path from the second nip N2 of the second folding roller pair 273 to the first auxiliary roller pair 274. The upstream second ejection path 291 is formed with the peripheral surface of the second roller 273B. The downstream second ejection path 292 is a path from the first auxiliary roller pair 274 to the ejection portion 230. The downstream second ejection path 292 is formed with an upper surface of the upper guide 242 of the first ejection path 240.

As shown in FIG. 2, the lower ejection tray 224 receives the sheet T ejected from the ejection portion 230 of the sheet folding processing portion 2. The lower ejection tray 224 is provided adjacently to the ejection portion 230. At a downstream end of the lower ejection tray 224 in a sheet ejection direction, a wall portion 224A that is vertically raised is provided for receiving the sheet T.

As shown in FIG. 2, the holding member 225 is a member for holding down from above the sheet T ejected from the ejection portion 230 of the sheet folding processing portion 2. The holding member 225 is provided adjacently to the ejection portion 230, in an upper portion of the lower ejection tray 224.

Next, the folding processing (operation) of the sheet folding processing portion 2 in the sheet post-processing apparatus 1 of the present embodiment is described. The folding processing is described hereinafter in an order of double-fold and triple-fold.

The double-fold processing is described hereinafter. The double-fold processing is performed in a case where a double-fold mode is selected by a user.

As shown in FIG. 2, the blade member 222 is put into a stand-by state by a crank mechanism (not shown), where the blade member 222 is positioned below a sheet placing surface of the upstream sheet placing member 201A and the downstream sheet placing member 201B. In the double-fold mode, the destination switching member 280 directs the destination of the sheet T, on which the first fold T1 is formed by the first folding portion 220, to the first ejection path 240. Then the sheet T is carried into the sheet folding processing portion 2, placed onto the upstream sheet placing member 201A and the downstream sheet placing member 201B, and aligned in the alignment portion 210.

Thereafter, the crank mechanism rotates to project the blade member 222, thereby dispatching the sheet T in the direction D3 that is vertical to the sheet T (direction penetrating the sheet T) by pushing the sheet T upwards. The first nip N1 of the first folding roller pair 223 is located in the destination of the sheet T directed by the blade member 222. As a result, the sheet T is carried into the first nip N1 of the first folding roller pair 223 in a state of being bent. As a result, as shown in FIG. 4, the first fold T1 is formed on the sheet T having passed through the first nip N1. Thereafter, the crank mechanism continues to rotate for returning the blade member 222 back to a stand-by position. The folding processing is thus continued.

Figure 5:
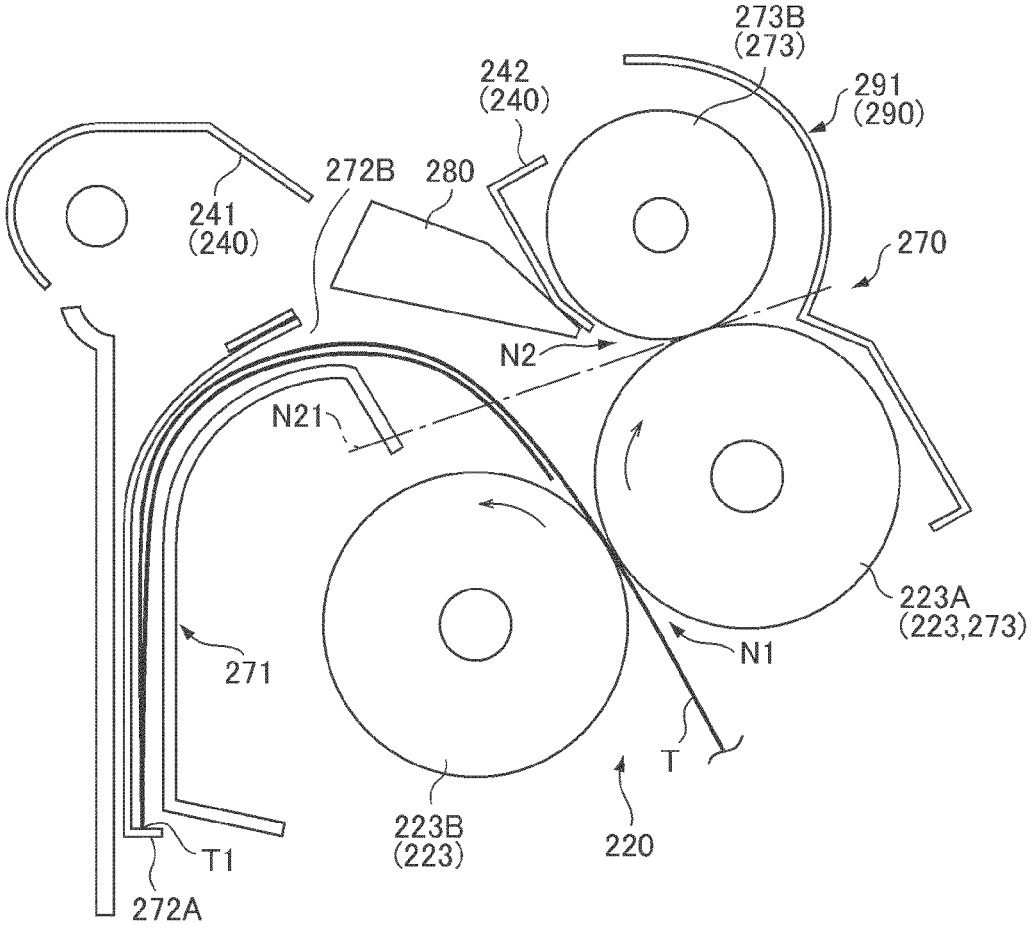
FIG. 5 is a schematic cross-sectional view illustrating a process of forming a second fold on the sheet T on which the first fold T1 is formed, after the process shown in FIG. 4.
Figure 6:
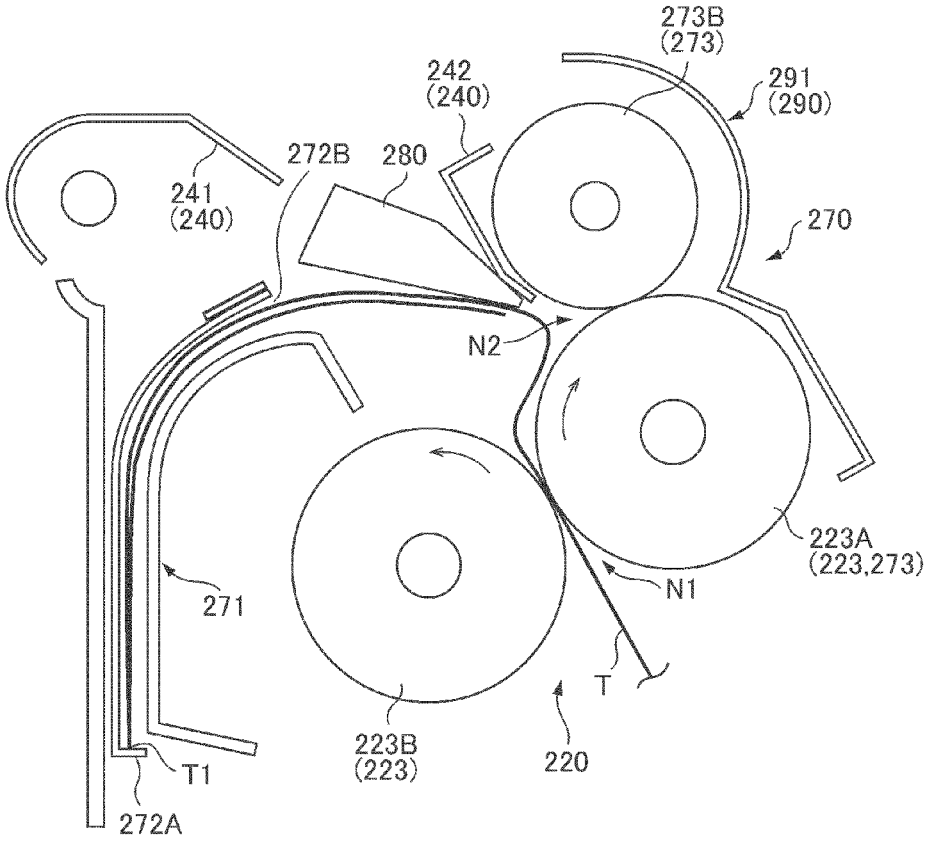
FIG. 6 is a schematic cross-sectional view illustrating a state after the process shown in FIG. 5.
Figure 7:
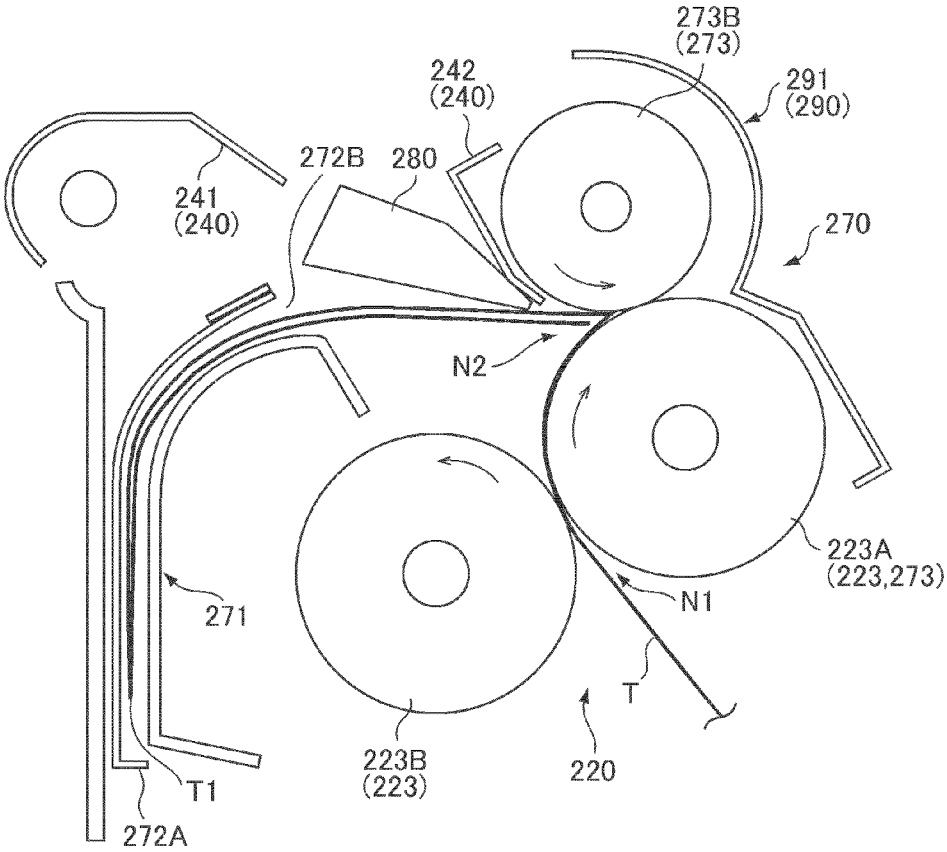
FIG. 7 is a schematic cross-sectional view illustrating a state after the process shown in FIG. 6.
Figure 8:
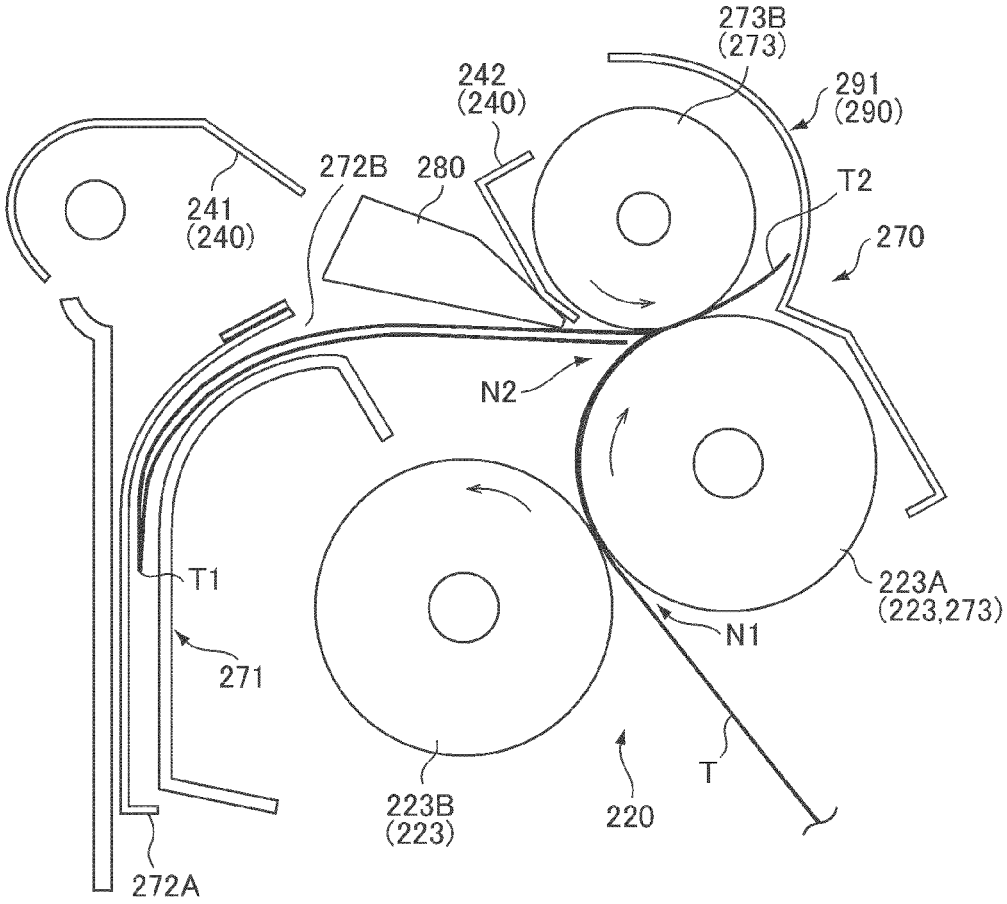
FIG. 8 is a schematic cross-sectional view illustrating a state after the process shown in FIG. 7, in which the second fold T2 is formed on the sheet T.

The triple-fold processing is described hereinafter. The triple-fold processing is performed in a case where a triple-fold mode is selected by a user. FIG. 5 is a schematic cross-sectional view illustrating a process of forming a second fold on the sheet T on which the first fold T1 is formed, after the process shown in FIG. 4. FIG. 6 is a schematic cross-sectional view illustrating a state after the process shown in FIG. 5. FIG. 7 is a schematic cross-sectional view illustrating a state after the process shown in FIG. 6. FIG. 8 is a schematic cross-sectional view illustrating a state after the process shown in FIG. 7, in which the second fold T2 is formed on the sheet T.

The process of forming the first fold T1 on the sheet T in the first nip N1 of the first folding portion 220 is the same as that in the double-fold processing shown in FIGS. 3 and 4. On the other hand, as shown in FIG. 5, the destination switching member 280 directs the destination of the sheet T, on which the first fold T1 is formed by the first folding portion 220, to the evacuation guiding portion 271 of the second folding portion 270.

As a result, the sheet T, on which the first fold T1 is formed, is conveyed to the evacuation guiding portion 271. The sheet T is introduced from the sheet introduction opening 272B of the evacuation guiding portion 271 and bent along a curved shape of the evacuation guiding portion 271. Then, the first fold T1 of the sheet T being conveyed in the evacuation guiding portion 271 is struck against the dead-end portion 272A in the evacuation guiding portion 271.

As shown in FIG. 6, the first folding roller pair 223 continues to rotate after that the first fold T1 of the sheet T is struck against the dead-end portion 272A in the evacuation guiding portion 271. Accordingly, the sheet T is bent to be convex toward the second nip N2 of the second folding roller pair 273 while contacting an inner surface of the evacuation guiding portion 271 and the destination switching member 280 and the like, that have curved shapes. Here, the space surrounded by the common roller 223A, the first roller 223B, the second roller 273B, the evacuation guiding portion 271, and the destination switching member 280 can be used as a space to bend the sheet to switch back from the evacuation guiding portion 271, thereby easily bending the sheet T.

Thereafter, as shown in FIG. 7, the sheet T is carried into the second nip N2 of the second folding roller pair 273 in a state of being bent. Furthermore, as the second folding roller pair 273 rotates, as shown in FIG. 8, the second fold T2 is formed on the sheet T having passed through the second nip N2. The sheet T on which the second fold T2 is formed is conveyed on the second ejection path 290, redispatched by the first auxiliary roller pair 274 and the lower ejection roller pair 231, and then ejected from the housing 11 of the sheet post-processing apparatus 1 through the ejection portion 230.

The sheet post-processing apparatus 1 of the present embodiment provides, for example, the following effects.

In the sheet post-processing apparatus 1 of the present embodiment, the common roller 223A and the first roller 223B are parallel in the conveying direction D1 in a case where the sheet T is guided toward the first folding portion 220, and an axial direction of the common roller 223A and the first roller 223B is substantially parallel to the conveyance surface (D1-D2) including the conveying direction D1. The blade member 222 moves in a direction D3, which is substantially orthogonal to a conveyance surface (D1-D2). The sheet post-processing device 1 includes an evacuation guiding portion 271, as a feeding portion, for evacuating the sheet T by deflecting and bringing in the sheet T on which the first fold T1 is formed by the first folding portion 220. The evacuation guiding portion 271 can evacuate the sheet T to the evacuation guiding portion 271, switch back the sheet T, and then feed the sheet T into the second nip N2.

As a result, according to the present embodiment, a shape curved toward the second nip N2 can be easily given to the sheet T by evacuating the sheet T to the evacuation guiding portion 271. This can eliminate need for an additional member for giving the shape curved toward the second nip N2 and need for a complex structure. Therefore, according to the present embodiment, simplification of structure and size reduction of a feeding portion, which bends and feeds a sheet on which a first fold is formed by the first folding portion to a second folding portion, can be realized.

In addition, in the sheet post-processing apparatus 1 of the present embodiment, the evacuation guiding portion 271 is disposed on an opposite side to the second folding roller pair 273 across the destination switching member 280. Since the evacuation guiding portion 271 faces the second folding roller pair 273, the sheet T can be easily carried into the second nip N2 only by continuing conveyance of the sheet T, without providing a folding auxiliary member for guiding a folding position on the sheet T to the second nip N2 that forms the second fold T2. In addition, the present embodiment can reduce a thickness of the sheet folding processing portion 2, and can thus realize size reduction of the sheet post-processing apparatus 1.

Furthermore, in the sheet post-processing apparatus 1 of the present embodiment, the evacuation guiding portion 271 has a dead-end portion 272A against which the first fold T1 on the sheet T evacuated into the evacuation guiding portion 271 is struck. Accordingly, in the present embodiment, by continuing rotation of the first folding roller pair 223 after that the first fold T1 on the sheet T is struck against the dead-end portion 272A, the sheet T is bent to be convex toward the second nip N2 of the second folding roller pair 273 while contacting an inner surface of the evacuation guiding portion 271 and the like, that have curved shapes. Therefore, in the present embodiment, the sheet T can be smoothly carried into the second nip N2.

In addition, in the sheet post-processing apparatus 1 of the present embodiment, the evacuation guiding portion 271 includes a sheet introduction opening 272B through which the sheet T is carried in. Furthermore, the sheet introduction opening 272B is positioned below the destination switching member 280 and above a nip plane N21 of the second nip N2 of the second folding roller pair 273. Therefore, in the present embodiment, the sheet T can easily enter the second nip N2.

In addition, a space surrounded by the common roller 223A, the first roller 223B, the second roller 273B, the evacuation guiding portion 271, and the destination switching member 280 is used as a space to bend the sheet T to switch back from the evacuation guiding portion 271. Therefore, in the present embodiment, the sheet T can smoothly bend in this space.

Furthermore, in the sheet post-processing apparatus 1 of the present embodiment, the dead-end portion 272A of the evacuation guiding portion 271 is disposed below the upstream end of the downstream sheet placing member 201B. Accordingly, the present embodiment can reduce a thickness of the sheet folding processing portion 2, and can thus realize size reduction of the sheet post-processing apparatus 1. Moreover, in the present embodiment, the lower the position of the sheet introduction opening 272B is, the greater R (radius) of the sheet introduction opening 272B can be, and therefore the sheet T can be naturally guided to the evacuation guiding portion 271.

Figure 9:
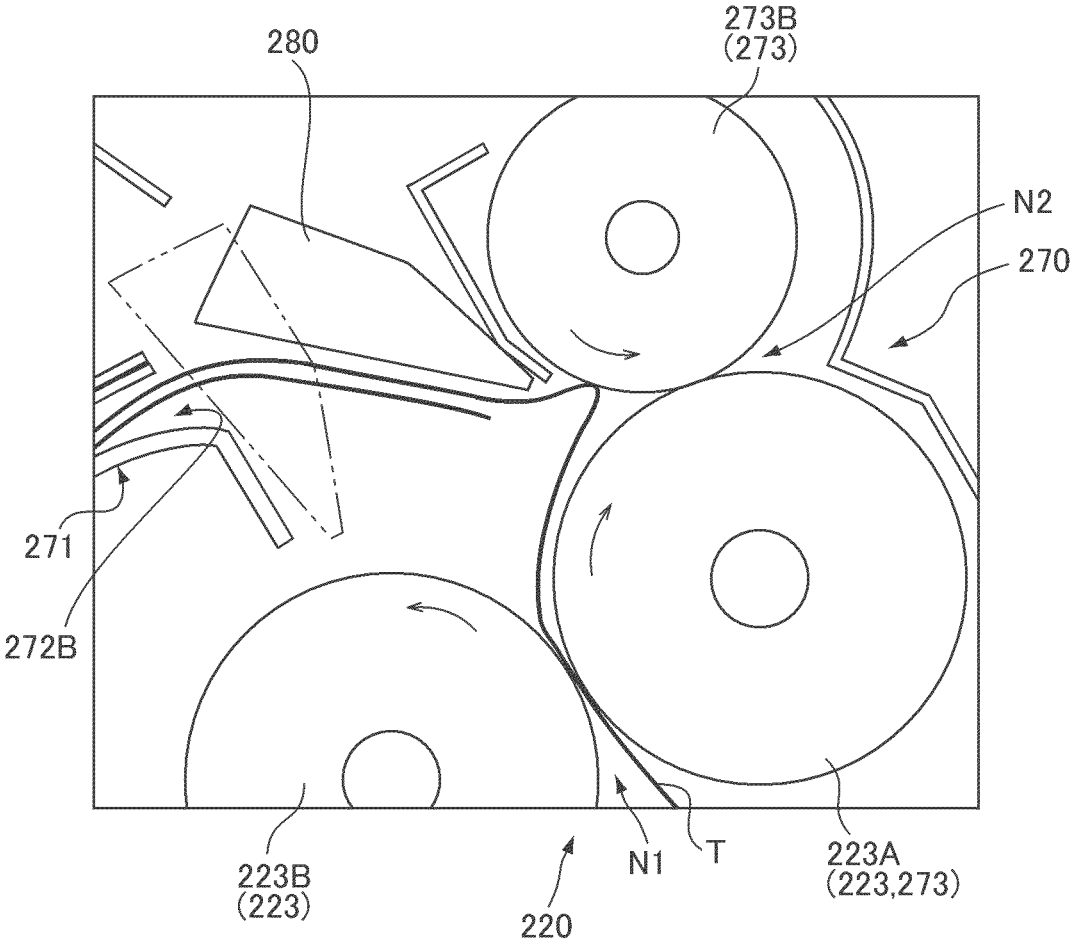
FIG. 9 is a schematic cross-sectional view illustrating a state in which a top of bend of the sheet T contacts an upstream side of a peripheral surface of a second roller 273B.
Figure 10:
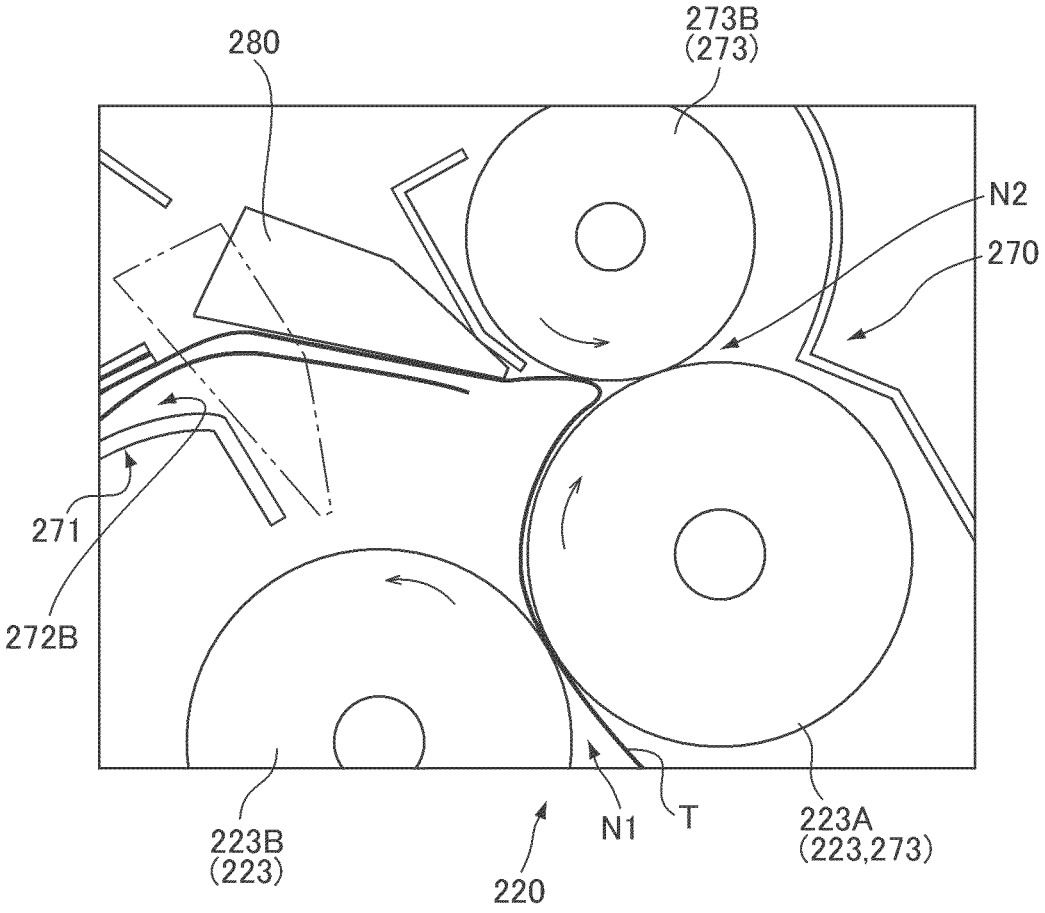
FIG. 10 is a schematic cross-sectional view illustrating a state in which the top of bend of the sheet T contacts a downstream side of the peripheral surface of a second roller 273B.

In addition, in the sheet post-processing apparatus 1 of the present embodiment, a peripheral surface of the second roller 273B is formed of a material of a low friction coefficient to be slippery. As a result, as shown in FIG. 9, even if the peripheral surface of the second roller 273B is in contact with the sheet T being conveyed to between the common roller 223A and the second roller 273B in the second folding roller pair 273, the sheet T can easily slip thereon. Accordingly, as shown in FIG. 10, the sheet T can easily be carried into the second nip N2 and the second fold T2 can easily be formed on the sheet T in the second nip N2.

Suppose that the peripheral surface of the second roller 273B is formed of a material of a high friction coefficient not to be slippery. In this case, if the peripheral surface of the second roller 273B is in contact with the sheet T being conveyed to between the common roller 223A and the second roller 273B in the second folding roller pair 273, the sheet T cannot easily slip thereon. As a result, the sheet T is likely in a state of not being carried into the second nip N2 (for example, the second fold T2 is formed in a state shown in FIG. 9). If the folding processing continues in such a state, a position at which the second fold T2 is formed (folding position) is variable and unstable.

A preferred embodiment of the present invention has been described above; however, the present invention is not limited thereto and can be carried out in various modes.

Figure 11:
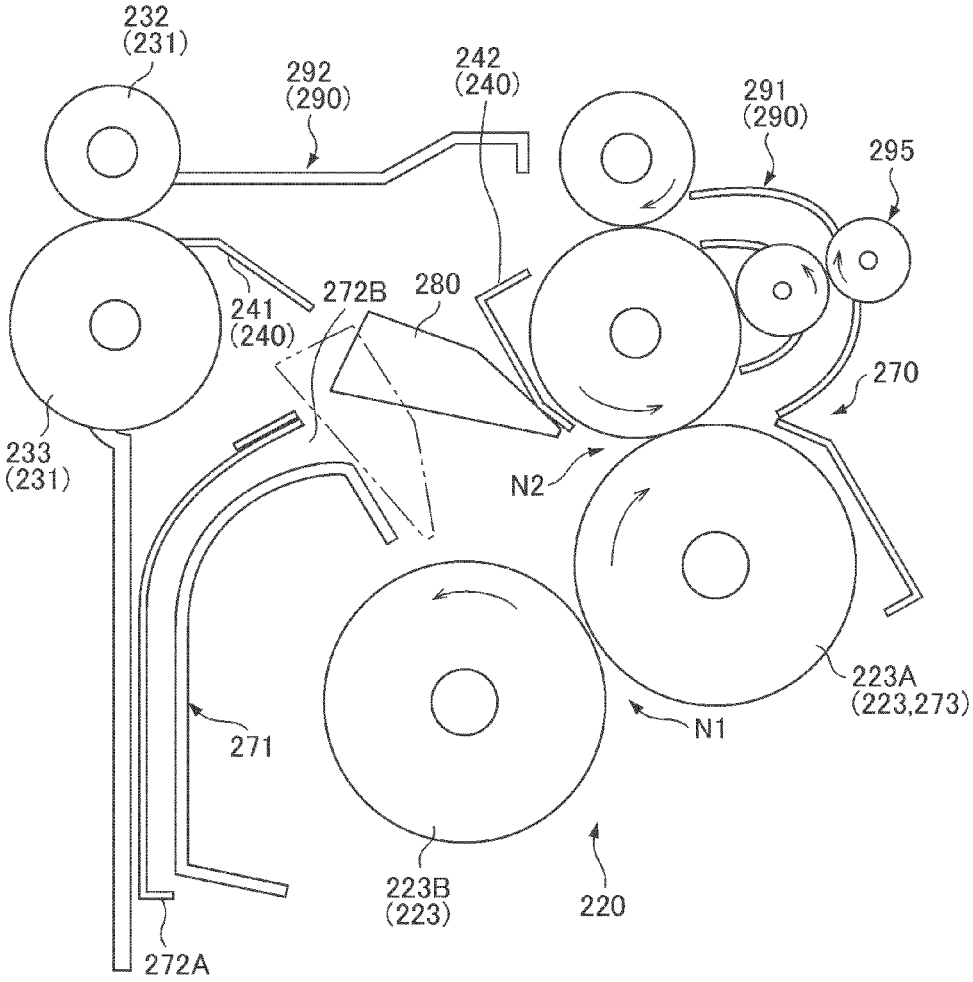
FIG. 11 is a schematic cross-sectional view illustrating a modification in which a second auxiliary roller pair 295 is provided on a second ejection path 290.

FIG. 11 is a schematic cross-sectional view illustrating a modification in which a second auxiliary roller pair 295 is provided on a second ejection path 290. As shown in FIG. 11, in addition to the first auxiliary roller pair 274, a second auxiliary roller pair 295 can be provided in the upstream second ejection path 291 of the second ejection path 290 on which the sheet T, on which the second fold T2 is formed, is conveyed. The second auxiliary roller pair 295 is composed of a pair of driving rollers or a combination of a driving roller and a driven roller. As a result, in the upstream second ejection path 291, the second auxiliary roller pair 295 dispatches the sheet T thereby improving sheet conveyance performance.

A type of the sheet post-processing apparatus is not particularly limited as long as the apparatus performs various post-processing on a sheet.

The image forming apparatus is not particularly limited and can be a copy machine, a printer, a facsimile machine, and a multi-functional printer having functions thereof.

The sheet post-processing apparatus of the present invention can be applied to a case of forming three (quad-fold) or more folds on a sheet.

The sheet is not limited to paper and can be, for example, a film sheet.

What is claimed is:

1. A sheet post-processing apparatus comprising: a first folding portion that forms a first fold on a sheet;

a second folding portion that forms a second fold on the sheet on which the first fold is formed by the first folding portion; and a destination switching portion that switches a delivery destination of the sheet on which the first fold is formed by the first folding portion between the second folding portion and a first ejection portion, the sheet post-processing apparatus being configured such that a first folding mode or a second folding mode can be selected, the first folding mode forming the first fold but not the second fold on the sheet by operating the first folding portion and switching the delivery destination of the sheet to the first ejection portion with the destination switching portion, and the second folding mode forming the first fold and the second fold on the sheet by switching the delivery destination of the sheet to the second folding portion with the destination switching portion and then operating the second folding portion, wherein: the first folding portion includes a first folding roller pair consisting of a common roller, a first roller, and a first nip formed between the common roller and the first roller, and a blade member that bends and feeds the sheet into the first nip, forms the first fold on the sheet in the first nip, and dispatches the sheet on which the first fold is formed toward the first ejection portion;

the second folding portion includes a second folding roller pair consisting of the common roller, a second roller, and a second nip formed between the common roller and the second roller, and a feeding portion that bends and feeds the sheet on which the first fold is formed by the first folding portion into the second nip, forms the second fold on the sheet in the second nip, and dispatches the sheet on which the first and second folds are formed toward a second ejection portion;

the common roller and the first roller are parallel in a conveying direction in a case where the sheet is guided toward the first folding portion;

an axial direction of the common roller and the first roller is substantially parallel to a conveyance surface including the conveying direction;

the blade member moves in a direction substantially orthogonal to the conveyance surface;

the feeding portion includes an evacuation guiding portion for evacuating the sheet that brings in and deflects the sheet on which the first fold is formed by the first folding portion, and the evacuation guiding portion being disposed downstream of the conveying direction with respect to the second roller across the destination switching portion and configured to bend back toward the conveyance surface; and the feeding portion evacuates the sheet to the evacuation guiding portion, switches back the sheet, and feeds the sheet into the second nip.

2. The sheet post-processing apparatus of claim 1, wherein the evacuation guiding portion is disposed on an opposite side to the second folding roller pair across the destination switching portion.

3. The sheet post-processing apparatus of claim 2, wherein the evacuation guiding portion is configured to form a sheet path curved at least once along a shape of a peripheral surface of the first roller.

4. The sheet post-processing apparatus of claim 2, wherein the evacuation guiding portion has a dead-end portion against which the first fold on the sheet evacuated into the evacuation guiding portion is struck.

5. The sheet post-processing apparatus of claim 3, wherein the evacuation guiding portion has a dead-end portion against which the first fold on the sheet evacuated into the evacuation guiding portion is struck.

6. The sheet post-processing apparatus of claim 1, wherein the evacuation guiding portion is configured to form a sheet path curved at least once along a shape of a peripheral surface of the first roller.

7. The sheet post-processing apparatus of claim 6, wherein the evacuation guiding portion has a dead-end portion against which the first fold on the sheet evacuated into the evacuation guiding portion is struck.

8. The sheet post-processing apparatus of claim 1, wherein the evacuation guiding portion has a dead-end portion against which the first fold on the sheet evacuated into the evacuation guiding portion is struck.

9. The sheet post-processing apparatus of claim 1, wherein the evacuation guiding portion includes a sheet introduction opening through which the sheet is brought in, the sheet introduction opening being positioned below the destination switching portion and above a nip plane of the second nip of the second folding roller pair.

10. The sheet post-processing apparatus of claim 1, wherein a space surrounded by the common roller, the first roller, the second roller, the evacuation guiding portion, and the destination switching member is used as a space to bend the sheet to switch back from the evacuation guiding portion.

11. The sheet post-processing apparatus of claim 1, wherein the first folding portion includes a sheet placing member on which a sheet to be fed into the first nip by the blade member is placed, the sheet placing member including an upstream side sheet placing member positioned on an upstream side in a sheet conveying direction and a downstream sheet placing member positioned to be spaced apart from the upstream sheet placing member across the blade member, on a downstream side in the sheet conveying direction, the evacuation guiding portion having a dead-end portion against which the first fold on the sheet evacuated into the evacuation guiding portion is struck, and the dead-end portion of the evacuation guiding portion being disposed below the upstream end of the downstream sheet placing member.

12. The sheet post-processing apparatus of claim 1, wherein a peripheral surface of the second roller is formed of a material of a low friction coefficient.

13. An image forming apparatus comprising: an image forming apparatus main body including an image forming unit that forms an image on a sheet; and the sheet post-processing apparatus of claim 1.

* * * * *